United States Patent [19]

Erickson

[11] Patent Number: 4,605,427

[45] Date of Patent: Aug. 12, 1986

[54] CRYOGENIC TRIPLE-PRESSURE AIR SEPARATION WITH LP-TO-MP LATENT-HEAT-EXCHANGE

[76] Inventor: Donald C. Erickson, 1704 S. Harbor La., Annapolis, Md. 21401

[21] Appl. No.: 501,264

[22] Filed: Jun. 6, 1983

Related U.S. Application Data

[63] Continuation-in-part of Ser. No. 480,786, Mar. 31, 1983.

[51] Int. Cl.[4] ..... F25J 3/02

[52] U.S. Cl. ..... 62/22; 62/30; 62/31; 62/39; 62/33; 62/34

[58] Field of Search ..... 62/23, 24, 27–34, 62/36, 42, 22, 38, 39

[56] References Cited

U.S. PATENT DOCUMENTS 2,699,046 1/1955 Etienne ..... 62/29

3,688,513 9/1972 Streich et al. ..... 62/29

*Primary Examiner*—Frank Sever

[57] ABSTRACT

This invention makes possible a substantial improvement in the distillation column efficiencies of a cryogenic air separation process while still retaining high reboil rates through the argon stripping section of the low pressure column. Those advantages result in a lower energy requirement for separating air while still yielding medium to high oxygen purity. In a triple pressure column arrangement, the medium pressure column efficiency is increased by reboiling it at two or more locations by latent heat exchange with both the high pressure and low pressure columns. The LP column vapor which reboils the MP column is taken from above at least part of the argon stripper, to maintain a high reboil rate through the stripper.

21 Claims, 3 Drawing Figures

CRYOGENIC TRIPLE-PRESSURE AIR SEPARATION WITH LP-TO-MP LATENT-HEAT-EXCHANGE

This application is a continuation-in-part of application Ser. No. 480786 filed Mar. 31, 1983 by Donald C. Erickson, now pending.

DESCRIPTION

1. Technical Field

This invention relates to processes and apparatus for separating air into at least medium-to-high purity oxygen plus optionally other products using cryogenic distillation. The invention permits a substantial reduction in the energy necessary to produce medium or high purity oxygen.

2. Background Art

In the conventional dual pressure distillation column configuration, overhead vapor from the high pressure (HP) column exchanges latent heat with bottom liquid from the low pressure (LP) column, thus providing HP column reflux liquid and LP column reboil vapor. It is known to conduct cryogenic distillation of air in a triple pressure column configuration, whereby various advantages may be obtained depending upon which configuration is adopted.

Prior art examples of triple pressure distillation include U.S. Pat. Nos. 1,557,907, 1,607,708, 1,612,164, 1,771,197, 1,784,120, 2,035,516, 2,817,216, 3,057,168, 3,073,130, 3,079,759, 3,269,131, 3,688,513, 3,563,047, and 4,254,629. Another triple pressure column arrangement is disclosed in co-pending application "Air Separation with Medium Pressure Enrichment", Ser. No. 416,980, filed Sept. 13, 1982, by Donald C. Erickson, now U.S. Pat. No. 4,433,989, which is incorporated by reference. Note that the addition of an auxiliary argon rectification section to a low pressure column above the argon stripping section does not result in an added distillation pressure. Since the vapor freely communicates throughout the column, it is a single pressure column with two rectifiers.

Most of the above triple pressure configurations involve a "series" latent heat exchange, i.e., one exchange from the HP to MP column, and another from the MP to LP column. U.S. Pat. No. 3,688,513 embodies a "series-parallel" latent heat exchange, i.e., the HP column overhead provides reboil to both the MP and LP columns, and the MP column is also reboiled by latent heat exchange with part of the supply air. This allows a lower HP column pressure, hence a lower supply air pressure, and thus an energy savings.

Most of the "low energy" triple pressure flowsheets, e.g., U.S. Pat. No. 4,254,629, necessarily produce only low or medium purity nitrogen, e.g., less than about 98% purity. This is because the medium pressure column is supplied some of the reboil that otherwise would go through the bottom section of the LP column, i.e., the argon stripping section. The low relative volatility between argon and oxygen requires that as much reboil as possible be sent through the argon stripping section to achieve the benchmark 99.5% purity. When a substantial fraction of the reboil is bypassed to the MP column, lower purity necessarily results. U.S. Pat. No. 3,688,513 discloses one method of avoiding this limitation, so as to produce high purity oxygen with a low energy flowsheet. An argon stripping section is incorporated in the bottom of the MP column as well as the LP column. The LP column recycles liquid overhead to the MP column, and is refluxed by latent heat exchange with oxygen enriched liquid bottom product from the HP column. Part of the low purity liquid oxygen in the MP column is withdrawn from an intermediate height and sent to the LP column for argon stripping, and the remainder is stripped of argon in the MP column argon stripper. The split of argon stripping duty between the LP and MP columns is proportional to the amount of reboil through the two stripping sections. Finally, all the high purity liquid oxygen from both argon strippers is gasified by latent heat exchange with HP column overhead gas.

The above configuration has at least three disadvantages. Many trays or separation stages are required in an argon stripper. The requirement to incorporate an argon stripper in the MP column makes it much taller and requires a greater pressure drop than for a similar MP column without an argon stripper. This in turn requires a higher supply air pressure to reboil it, i.e., more energy. Also, argon stripping at MP column pressure is less efficient than at LP column pressure, due to improved relative volatility at lower pressures. Secondly, almost all of the MP column reboil must be supplied at the bottom, with only a small amount at an intermediate height, as the latter amount bypasses both argon strippers. Thus the MP column does not operate as efficiently as is possible with several reboil locations, with lesser reboil at the bottom. Thirdly, refluxing the LP column overhead by latent heat exchange with oxygen enriched liquid has two undesirable consequences—it generates an entropy of liquid mixing, leading to efficiency loss, and it establishes a fairly high reflux temperature, which precludes any appreciable nitrogen content in the LP column overhead fluid. Also, there is only a minimal amount of liquid nitrogen available for refluxing the MP column overhead.

Certain optional features incorporated in the invention disclosed herein are known in some context in the prior art, although not in the especially advantageous embodiments disclosed herein. These include the use of thermocompressors to recover pressure letdown energy from a fluid stream by compressing another fluid stream (U.S. Pat. No. 4,091,633), and the recycle of overhead liquid from the LP column to the MP column (U.S. Pat. No. 3,688,513). Other examples are the use of multiple reboilers and reflux condensers on a single column (U.S. Pat. No. 3,605,423) and the use of two combined reboiler/reflux condensers to connect a pair of columns (U.S. Pat. Nos. 3,277,655, 3,327,489, and 4,372,765). It is also known to generate high pressure oxygen by pumping liquid oxygen to high pressure and then exchanging latent heat with compressed argon. The liquified argon is then regasified at lower pressure by latent heat exchange with HP column vapor. The low pressure argon is then recompressed to complete a closed cycle loop. This configuration is disclosed in "The Production of High-Pressure Oxygen" by H. Springmann, Linde Report on Science and Technology 31/1980.

The removal of nitrogen only from air, leaving a low purity oxygen containing about 5% argon, can be done quite efficiently in only two columns. Thus the major purpose of the third (LP) column is to further purify the oxygen by argon removal, to medium purity (96 to 98%) or higher.

"Latent heat exchange" refers to an indirect heat exchange process wherein a gas condenses on one side of the heat exchanger and a liquid evaporates on the other, e.g., as occurs in the conventional reboiler/reflux condenser. Normally part of the heat exchange will also unavoidably be due to some sensible heat change of the fluids undergoing heat exchange—thus the label merely signifies the major mechanism of heat exchange, and is not intended to exclude presence of others.

DISCLOSURE OF INVENTION

The disadvantages of the prior art are overcome by providing a triple pressure distillation process or apparatus in which the LP column has an argon stripping section and at least one rectification section, and is reboiled by the HP column, and in which there is at least one exchange of latent heat from an intermediate height of the LP column to an intermediate height of the MP column. Thus the MP column is reboiled by both the HP and LP columns. The MP column functions to remove most or all of the nitrogen from the oxygen enriched liquid received from the HP column bottom, and supplies low purity liquid oxygen containing argon as impurity to the LP column. The latent heat exchange from LP to MP column intermediate height ensures high reboil flow through the argon stripping section of the LP column, and then transfers the reboil to the midsection of the MP column where that column requires high reboil. Substantially all of the liquid bottom product of the MP column is supplied to and further purified in the LP column.

The basic novel configuration disclosed above can be combined with many additional optional variations, depending on product purity, product mix, and product pressure desired. The LP column rectifier can be used to recover crude argon, or to recycle it as either gas or liquid to the MP column, where it exits with the $N_2$. This argon rectifier can be refluxed by latent heat exchange with liquid from another intermediate height of the MP column, or less preferably with oxygen enriched liquid from the HP column as is done conventionally.

In addition to or in lieu of the LP argon rectifier, there may be a LP nitrogen rectifier. This is necessary when the low purity liquid oxygen from the MP column still has appreciable $N_2$ content, i.e., more than about 1 or 2%. The LP $N_2$ rectifier overhead can be recycled as gas or liquid to the MP colunm, or removed from the cold box by a vacuum compressor. It can be refluxed by direct injection of liquid $N_2$ or indirect latent heat exchange with liquid $N_2$, as disclosed in copending application Ser. No. 480,786 which disclosure is incorporated by reference.

A low energy configuration can be adopted, wherein in addition to being reboiled by latent heat exchange with HP column overhead vapor, the MP column is also reboiled by latent heat exchange with either HP column intermediate height vapor or with supply air. It is particularly advantageous to reboil the MP column from all three of those sources, as that minimizes the amount of each individual reboil, and thus maximizes the fluid $N_2$ obtainable from the HP column and minimizes MP column entropy generation.

If the liquid oxygen bottom product of the LP column is gasified in situ by latent heat exchange with HP column overhead nitrogen gas, then an oxygen purity of about 96 to 98% will be obtained when using the low energy flowsheet described above. Greater oxygen purity, e.g. above 99%, can be obtained by withdrawing at least part of the purified oxygen as liquid and then gasifying it by exchanging latent heat with a vapor from above at least part of the argon stripping section of the LP column. There are basically two choices here—the LOX can be gasified directly by LP column intermediate height vapor, which would require that the LOX pressure be reduced slightly and that an $O_2$ vacuum compressor be used to remove the gasified oxygen from the cold box. Secondly, overhead vapor (crude argon having at most 30% $O_2$) from the LP column rectification section could be compressed external to the cold box, and then exchange latent heat with LOX which has been pumped to pressure. This directly generates pressurized oxygen without an oxygen compressor. In either case the condensed LP column vapor is returned to the LP column as reflux.

Whenever recycle of either a vapor or a liquid is required from the LP column to the MP column, it can be done at least partly by a thermocompressor which is powered by and lets down the pressure of one or both of the liquids from the HP column.

Many other standard options can and would normally be applied to the disclosed configuration, including but not limited to: various means of developing refrigeration, e.g., $N_2$ expansion from HP column, or air expansion to MP column; various heat exchange configurations for exchanging sensible heat between fluid streams; various column arrangements, with latent heat exchangers either internal to or external to the columns; various main heat exchanger types, e.g., reversing, regenerative, non-reversing plate-fin, etc.; various impurity ($H_2O$, $CO_2$, hydrocarbons) removal techniques—mole sieves, reversing exchangers, etc.; and additional feed entry points to or product take-off points from any of the columns, such as rare gas recovery, liquid recovery, instrument nitrogen recovery, and the like.

BRIEF DESCRIPTION OF DRAWINGS

The three figures illustrate several configurations which embody the basic disclosure plus possible combinations of optional features as described above which are particularly advantageous.

High purity oxygen is produced directly at high pressure by latent heat exchange with compressed recycle crude argon, which is subsequently used as reflux for the argon recovery rectification section. LP column $N_2$ rectification section overhead vapor is at least partly recycled to the MP column by a thermocompressor powered by expanding liquid nitrogen.

BEST MODE FOR CARRYING OUT THE INVENTION

Figure 1:
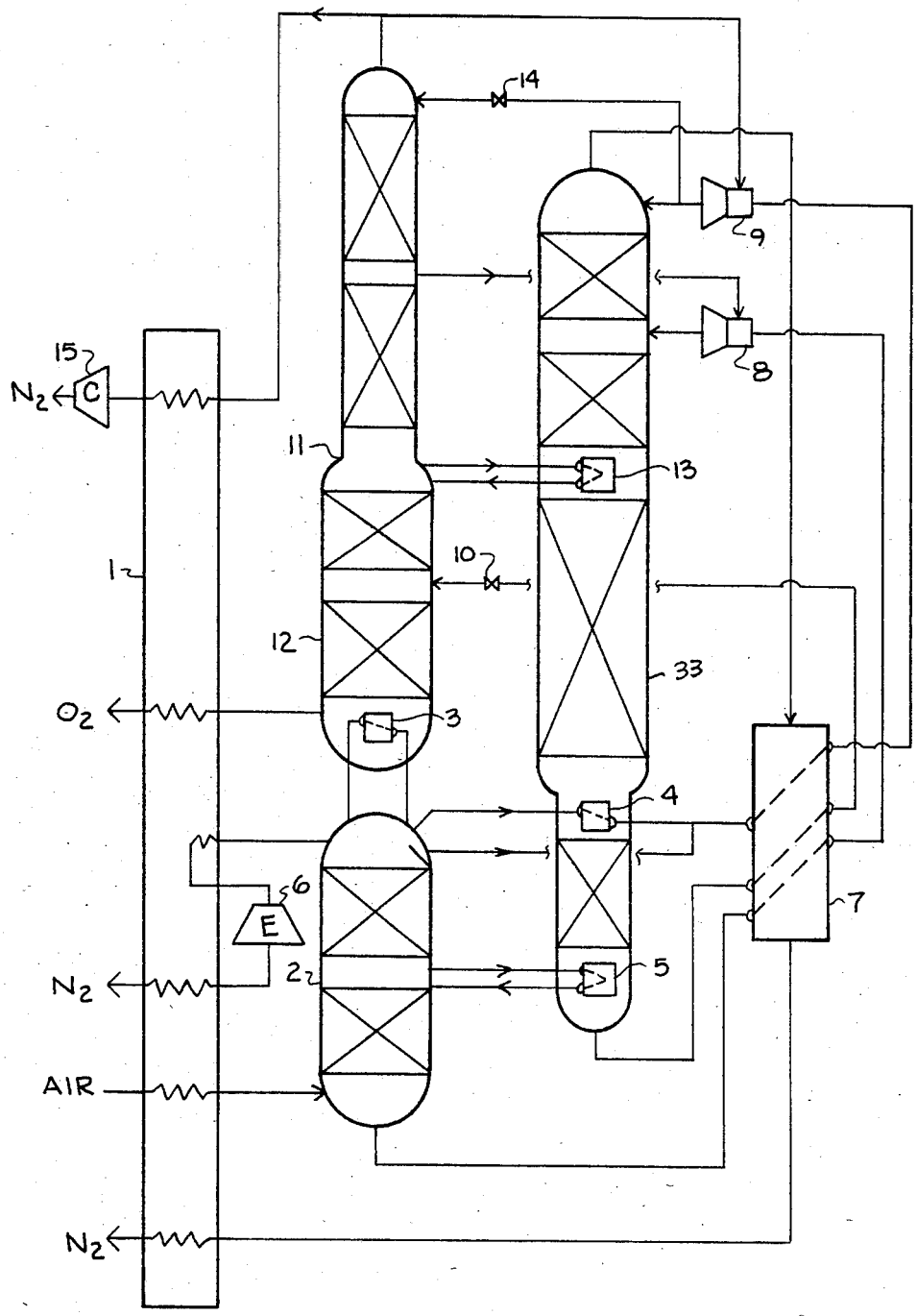
In FIG. 1 medium purity oxygen is produced by gasifying LP column sump liquid in situ, and the LP column has one rectification section for $N_2$ removal. The $N_2$ rectification section is refluxed by direct injection of liquid $N_2$, and gaseous overhead is recycled to the MP column.

Referring to FIG. 1, compressed feed air exits main heat exchanger 1 in a cooled, cleaned state and is supplied to HP rectifier 2. The HP column is refluxed by condensed nitrogen from reboiler/reflux condenser 3, and also by at least one of reboiler/reflux condensers 4 and 5. HP column overhead vapor is condensed in 4, and intermediate height vapor is condensed in 5. Part of the overhead nitrogen gas in HP column 2 is withdrawn to provide refrigeration by partial warming and then expansion in expander 6. The oxygen enriched liquid bottom product and the liquid nitrogen overhead product from column 2 are subcooled in sensible heat exchanger 7 and then introduced at least partly into medium pressure (MP) column 33 via means for pressure reduction 8 and 9. The latter may be valves or work producing expanders and the like, but advantageously for this flowsheet will be thermocompressors as illustrated.

Substantially all of the further oxygen enriched liquid bottom product from the MP column is then transported to the low pressure (LP) column 11 via flow control mechanism 10. Since the LP column pressure is between 0.1 and 0.6 atmospheres less than the MP column, this may be a valve or the like. However in some cases the barometric head associated with the vertical lift will require a pump or other means of forced transport. The further oxygen enriched liquid bottom product contains at least about 2% and as much as about 30% nitrogen, plus substantially all of the oxygen and argon. The bulk of the nitrogen introduced by the supply air exhausts from the overhead of column 33 to the atmosphere via heat exchangers 7 and 1.

The LP column 11 contains an argon stripping section 12 comprised of a zone of countercurrent gas-liquid contact between reboiler/reflux condenser 3 and the feed entry point. At some intermediate height above at least part of the argon stripper 12 latent heat is transferred from LP column 11 to an intermediate height of MP column 33 via reboiler/reflux condenser 13. The nitrogen rectification section of LP column 11 is additionally refluxed by direct injection of liquid nitrogen from the HP column overhead through means for flow control and pressure letdown 14, e.g., a valve. The overhead vapor from the column 11 $N_2$ rectification section, which is predominantly $N_2$ with no more than about 10% $O_2$, can be recycled to the MP column by a cold compressor or removed from the cold box by an ambient vacuum compressor 15. The most preferred arrangement as illustrated includes both, where the cold compressor is the thermocompressor 9, and where the ambient compressor 15 is mechanically powered by the work developed by expander 6.

The $N_2$ rectification section can be caused to operate more efficiently by recycling vapor from an intermediate height to the MP column also, using thermocompressor 8.

There exists a substantial degree of latitude in locating the intermediate heights for feed introduction, side product withdrawal, and side reboil and reflux on the various columns, and the artisan will establish those locations using standard distillation calculation techniques to best suit each particular application. For example, reboiler/reflux condenser 13 can connect to LP column 11 at or below the feed introduction height, in lieu of above it, as illustrated.

Liquid oxygen in the sump of column 11 is gasified by heat exchanger 3 and withdrawn at a medium purity of at least 96%. The purity depends primarily on the amount of reboil which is supplied to reboiler/reflux condensers 4 and 5 and hence bypasses the argon stripper 12.

In one projected set of preferred operating conditions for the FIG. 1 flowsheet, the HP column overhead pressure will be about 4 ATA (atmospheres absolute), the MP column overhead will be 1.35 ATA, and the LP bottom pressure will be about 1 ATA, with the overhead at 0.85 ATA. For every 100 moles of supply air, about 14 moles of gas will be condensed in reflux condenser 5 and about 8 in condenser 4. 51 moles of liquid will be withdrawn from the HP column bottom, and the MP column bottom liquid will contain about 15% $N_2$. 16.5 moles of $N_2$ containing about one-half percent $O_2$ impurity are expanded for refrigeration. About one and one-half moles of vapor containing about 30% oxygen are thermocompressed by thermocompressor 8, and one mole of nitrogen containing less than 5% oxygen is thermocompressed by 9. 6.5 moles of $N_2$ are removed by vacuum compressor 15, and 5 moles of liquid $N_2$ are directly injected into the LP column overhead. The product is 21 moles of $O_2$ at better than 97% purity and about 0.7 ATA at the exit from the cold box. The reboil supplied to latent heat exchanger 13 corresponds to that supplied to latent heat exchanger 3 less the fraction consumed in gasifying liquid oxygen and the fraction sent up the $N_2$ rectification section; in general the heat exchange duty of reboiler 13 will be comparable to or greater than that of reboiler 4 or 5.

Figure 2:
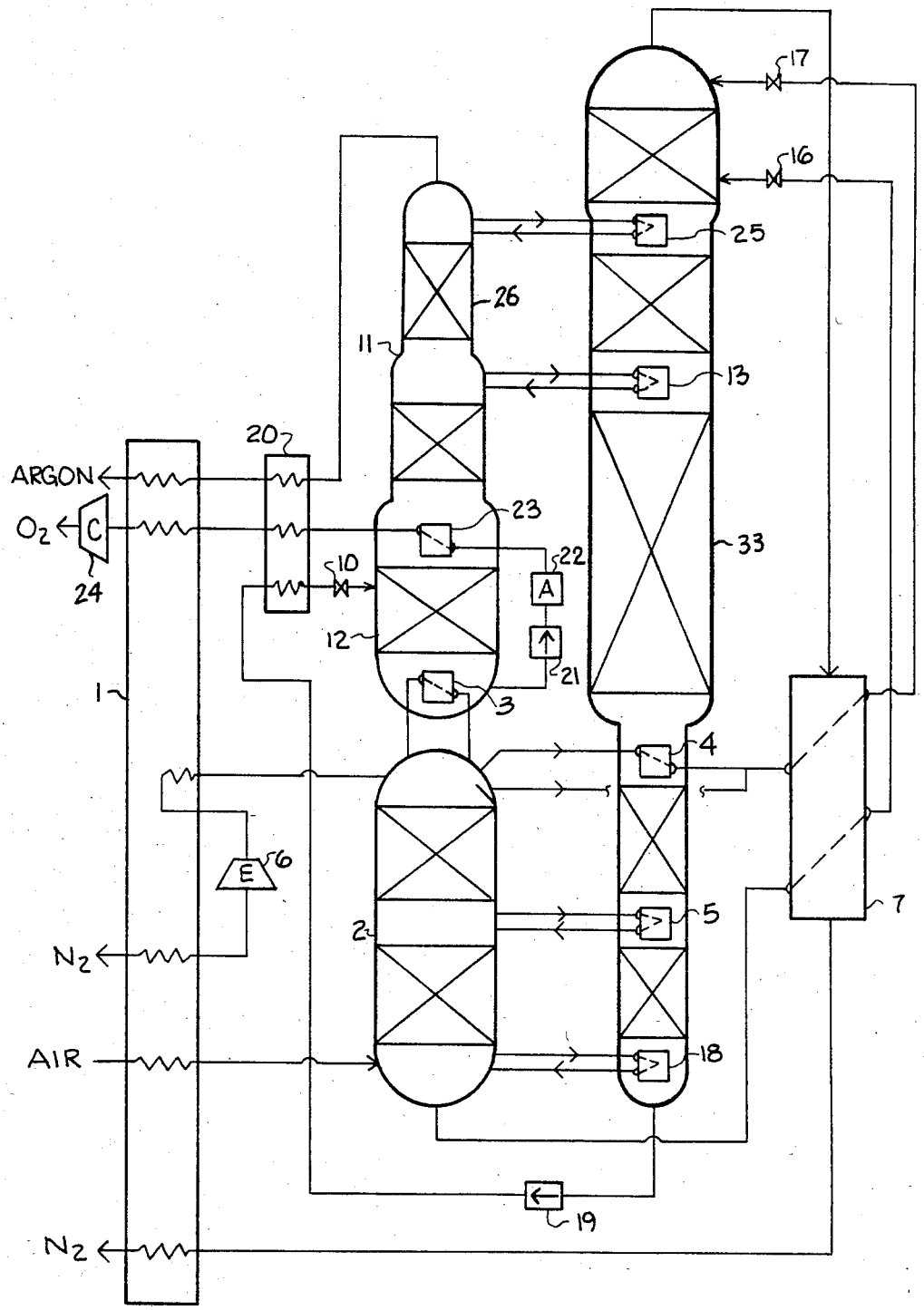
In FIG. 2, the LP column has only one rectification section, for argon removal and production. The MP column bottom product contains less than about 2% $N_2$. High purity oxygen is produced, and extra reboil in the LP argon stripping section is obtained by exchanging latent heat between LP column intermediate height vapor and depressurized LOX.

In FIG. 2, components numbered 1–7, 10–13, and 33 are similar in design and function to the same numbered components of FIG. 1, and the same description applies. This flowsheet depicts the embodiment wherein the further oxygen enriched liquid discharged from the MP column bottom section has been purified to less than 1 or 2% $N_2$ content, and hence an LP $N_2$ rectifier is not required. Thus pressure letdown valves 16 and 17 replace thermocompressors 8 and 9, since there is no requirement to recycle $N_2$ from the LP to MP column.

In this embodiment the LP rectifier section 26 is primarily for removal of and enrichment of argon, and the LP overhead vapor will correspondingly be predominantly argon.

The argon rectifier is refluxed by side refluxer 13, which is also a side reboiler for the MP column, as described previously. The rectifier is also refluxed at the top by reboiler/reflux condenser 25 which is also a side reboiler for the MP column, connecting to a higher intermediate height than side reboiler 13.

The lower $N_2$ content of the MP column bottom product requires a higher bottom temperature for the same column pressure. Thus if the MP column were reboiled only by reboilers 4 and 5, a higher HP column pressure would be required, resulting in higher energy input. In order to avoid this higher energy penalty, a third reboiler 18 is added at the bottom of the MP column, which is powered by latent heat exchange with supply air. Supply air condenses at a higher temperature than does HP column intermediate vapor. Although all three reboilers 4, 5, and 18 are not essential to this embodiment, they improve the efficiency of both the HP and MP columns and allow a greater energy reduction than is possible otherwise.

The FIG. 2 flowsheet is adapted to produce high purity oxygen. This is done by providing additional reboil through the argon stripper 12 beyond that made possible by intermediate reboiler/reflux condenser 13. In particular, liquid oxygen is not gasified in the sump of the LP column, but is gasified by latent heat exchange with a gas stream that has already traversed at least part of the argon stripper. This is done in LOX gasifier/side refluxer 23. The LOX must be further depressurized by at least 0.1 ATA to be cold enough to supply this reflux duty. This depressurization is accomplished in means for flow control 21. In some cases that will simply be a valve, but if the required depressurization is less than the required increase in barometric head associated with the vertical lift, then it may be a pump or the like. This same consideration applies to means for flow control 10 and 19. An absorber 22 for hydrocarbon purification is also provided to prevent dangerous accumulation of hydrocarbons in gasifier 23. The various mass streams entering and exiting the LP column may exchange sensible heat in heat exchanger 20. Similarly, the gas streams entering and exiting the cold box exchange sensible heat in heat exchanger 1. The high purity LOX will normally be gasified below atmospheric pressure, and hence a vacuum compressor 24 will be required to raise it to delivery pressure.

All of the flowsheets disclosed have a low energy requirement, efficient HP and MP distillations, and particularly efficient argon stripping due to the lower than normal pressure. Although multiple reboilers/reflux condensers are required, their combined heat exchange duty is only marginally greater than the duty of the single reboiler/reflux condenser of a conventional dual pressure column. The FIG. 2 embodiment is particularly attractive due to its simplicity. Both high purity oxygen and argon are produced in only three columns involving generally the same order of magnitudes of number of trays as are present in the dual pressure plant. The oxygen delivery pressure is reduced one increment to permit lower supply air pressure, and is reduced another small increment to permit additional purification. Thus the only drawback is the need for an oxygen vacuum compressor taking suction at about 0.5 ATA.

Figure 3:
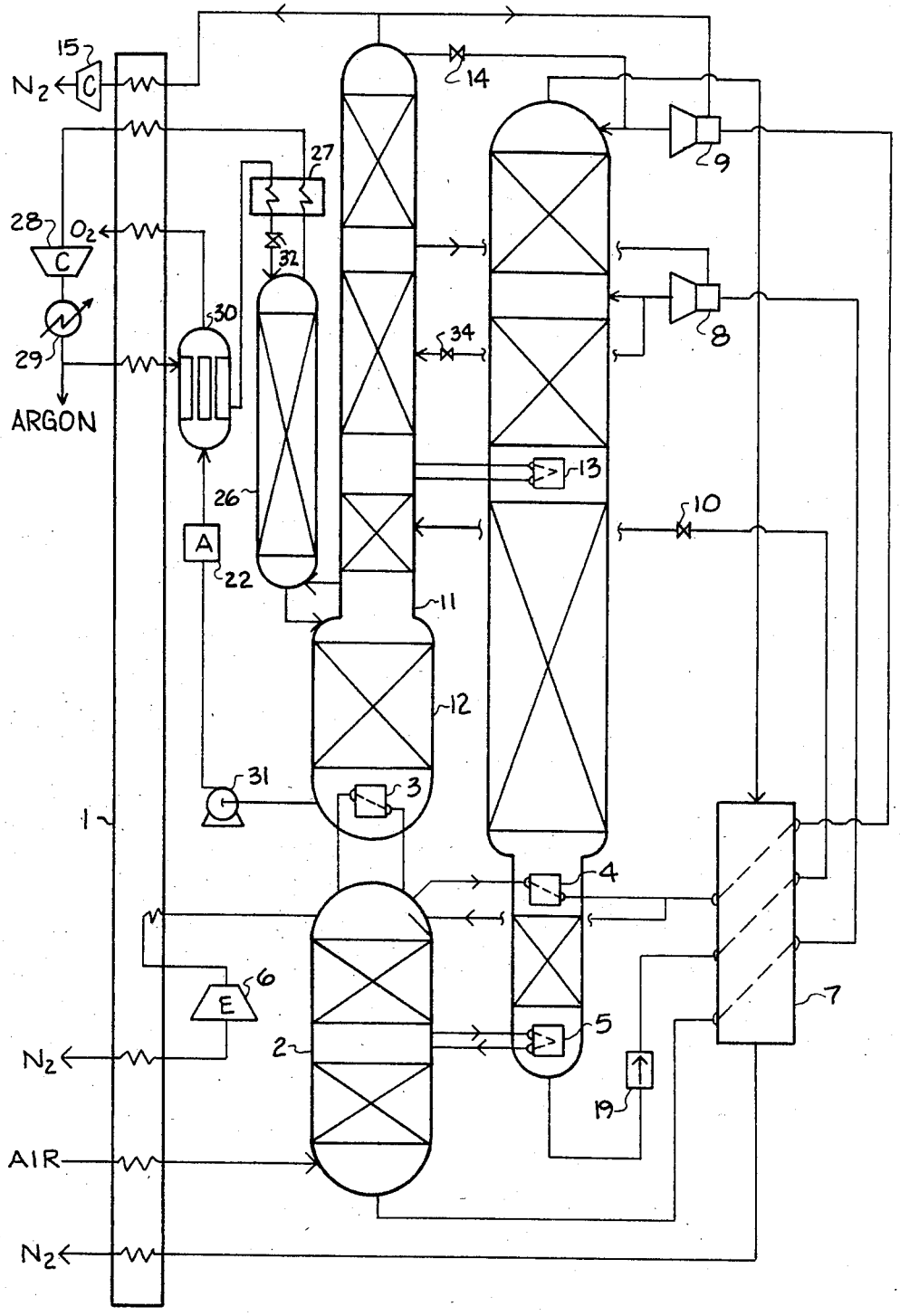
In FIG. 3, the LP column has two rectification sections—a nitrogen removal section which receives liquid feed from the MP column and is refluxed by direct injection of liquid nitrogen from the HP column overhead, and an argon recovery section.

FIG. 3 illustrates additional embodiments possible within the scope of the basic invention, including a means of producing high purity oxygen without the use of an oxygen vacuum compressor. It also illustrates the configuration applicable when the LP column has both a nitrogen and an argon rectification section. In FIG. 3, components numbered 1–15, 26, 19 and 22 are similar in function and description to the same numbered components of FIG. 1 or 2. It is desirable to introduce the further oxygen enriched liquid into the nitrogen rectification section, to allow essentially complete stripping of residual nitrogen before the mixture reaches the height at which the argon rectification section 26 connects to the LP column. Similar to FIG. 1, the residual $N_2$ is removed from the LP column by vapor compression to the MP column and/or to atmosphere. This could alternatively be done by liquid recycle to the MP column, as described in the parent application.

As in FIG. 2, the additional argon stripper reboil necessary for high purity oxygen is obtained in FIG. 3 by two means; the LP to MP intermediate reboiler/intermediate refluxer 13, and by withdrawing high purity LOX from the LP column bottom and gasifying it by latent heat exchange with gas from further up the LP column. In this embodiment however, the gas is taken from the overhead of the argon rectifier 26, and the gas is compressed in recycle compressor 28 prior to exchanging latent heat with the liquid oxygen (LOX). Correspondingly the LOX can be gasified at higher pressure, and LOX pump 31 develops that pressure. The high purity oxygen is thus generated directly at almost any desired pressure without need for an oxygen compressor. Oxygen compressors represent a safety concern, and generally operate at higher clearances and lower efficiencies to retain acceptable safety and reliability. Provided there is no more than about 30% oxygen in the recycle argon stream, the argon compressor can reflect the lower cost construction and higher efficiency characteristic of an air compressor. The liquefied argon from latent heat exchanger 30 is returned to the argon rectifier 26 as reflux via sensible heat exchanger 27 and means for pressure letdown 32. Heat of compression is removed in cooler 29. The net production of crude argon, which will only amount to about 5% of the recycle stream (less compressor losses), can be withdrawn either within or outside the cold box, and would normally be subjected to further purification.

The FIG. 3 embodiment illustrates an additional feature that is desirably incorporated with a LP nitrogen rectifier incorporating vapor withdrawal. That feature is the provision of an intermediate height liquid feed location which is supplied part of the oxygen enriched liquid via means for flow control and pressure reduction 34. Even though this introduces additional nitrogen into the LP column, surprisingly it increases overall LP column efficiency and hence process efficiency.

All three of the illustrated embodiments incorporate means for reducing the energy requirement and for increasing column efficiencies using intercolumn exchanges of heat. Thus all three can operate at similar column pressures, e.g., 3 to 6 ATA in the HP column, 1 to 2 ATA in MP column, and 0.6 to 1.5 ATA in the LP column, where the LP column is at least 0.1 ATA lower in pressure than the MP column. The MP column intermediate height liquid that exchanges latent heat with LP column intermediate height vapor can have a composition of at least 50% oxygen; this ensures that the reboil is transferred to the MP column at a low enough height to provide maximum useful effect.

Many additional combinations of described features incorporating the basic inventive entity will be apparent to the artisan beyond the three embodiments illustrated. Every combination of the following choices is possible:

- LP column has argon rectifier only, nitrogen rectifier only, or both
- MP column is reboiled by any combination of latent heat exchange with HP overhead vapor, HP intermediate height vapor, or supply air
- for flowsheets incorporating LP column nitrogen rectifiers, nitrogen removal may be by liquid recycle or by vapor compression or both
- LP column bottom liquid can be gasified in situ, or by latent heat exchange with in situ LP column vapor or compressed LP column vapor;

plus other features previously described or known in the prior art.

What is claimed is:

1. A process for producing oxygen of at least about 96% purity comprising (a) feeding at least part of a supply of moisture and $CO_2$ free air to a high pressure (HP) rectification column;

(b) feeding at least part of the oxygen enriched liquid bottom product from the HP column to a medium pressure (MP) column;

(c) feeding substantially all of the further oxygen enriched liquid bottom product from the MP column to a low pressure (LP) column comprised of an argon stripping section and at least one rectification section;

(d) reboiling both the MP and LP columns by latent heat exchange with HP column vapor;

(e) exchanging latent heat between vapor from an intermediate height of the LP column and liquid from an intermediate height of the MP column, and returning reflux to the LP column and reboil to the MP column;

(f) withdrawing gaseous $N_2$ from the MP column overhead (g) withdrawing oxygen of said purity from the bottom of said LP column.

2. The process according to claim 1 further comprising refluxing the rectification section of the LP column by latent heat exchange with boiling liquid nitrogen; recycling liquid overhead product from the LP column to an intermediate height of the MP column; and withdrawing substantially all of the gaseous oxygen product from the bottom of the LP column.

3. The process according to claim 1 further comprising refluxing the rectification section of the LP column at least partly by direct injection of liquid nitrogen; and recycling at least part of the nitrogen rectifier vapor to the MP column by compression.

4. The process according to claim 1 further comprising withdrawing oxygen of at least 98% purity from the LP column bottom in liquid phase; gasifying the liquid oxygen by latent heat exchange with a vapor from the LP column; and returning at least part of the condensed LP column vapor to the LP column as reflux.

5. The process according to claim 4 further comprising reducing the pressure of the liquid oxygen prior to latent heat exchange with LP column vapor, and compressing the product gaseous oxygen.

6. The process according to claim 5 further comprising removing crude argon from the top of the LP column rectification section and refluxing that section by latent heat exchange between overhead vapor and at least one of MP column liquid from an intermediate height and at least part of the said oxygen enriched liquid.

7. The process according to claim 6 further comprising providing a second rectification section for the LP column; removing a fluid containing at least nitrogen from the LP column using that rectification section; and recycling at least part of that fluid to the MP column.

8. The process according to claim 4 further comprising removing crude argon vapor of at least 70% purity from the top of the LP column rectification section; warming, compressing, and cooling it; pressurizing the liquid oxygen with a pump; exchanging latent heat between the pressurized liquid oxygen and the compressed crude argon; and returning the condensed crude argon to the rectification column as reflux.

9. The process according to claim 8 further comprising providing a second rectification section for the LP column for removal of nitrogen-containing fluid from the LP column.

10. The process according to claim 1 wherein the HP column pressure is in the range of 3 to 6 ATA, the MP column pressure is in the range of 1 to 2 ATA, the LP column pressure is in the range of 0.6 to 1.5 ATA, and at least 0.1 ATA lower than MP column pressure, and wherein the MP column intermediate height liquid supplied to exchange latent heat with LP column vapor has a composition of at least 50% oxygen.

11. The process according to claim 1 further comprising reboiling the MP column by latent heat exchange with at least one of vapor from an intermediate height of the HP column and feed air.

12. An apparatus comprising: means designed for separating from air, oxygen of at least 96% purity by cryogenic distillation including a high pressure rectification column; a medium pressure distillation column which is reboiled in part by the HP column; a low pressure distillation column comprising rectifier and argon stripper which is reboiled by the HP column; a reboiler/reflux condenser which exchanges latent heat between LP column intermediate height vapor and MP column intermediate height liquid; and means for withdrawing oxygen of said purity from the bottom of said LP column And a conduit for withdrawal of gaseous $N_2$ from the MP column overhead.

13. Apparatus according to claim 12 further comprising means for refluxing an intermediate height of the LP column by exchanging latent heat between liquid oxygen withdrawn from the LP column bottom and vapor from the LP column intermediate height.

14. Apparatus according to claim 12 in which the LP column overhead fluid is predominantly $N_2$ and further comprising: a conduit for directly injecting liquid $N_1$ into the LP column overhead; and at least one conduit and compressor for withdrawing LP column overhead gas for delivery to at least one of the MP column and the ambient exhaust.

15. Apparatus according to claim 12 in which the LP column overhead fluid is predominantly $N_2$ and further comprising: a reflux condenser for the LP column which exchanges latent heat with liquid $N_2$ from the HP column and a means for transporting LP column overhead liquid to the MP column.

16. Apparatus according to claim 12 wherein the LP column overhead fluid is predominantly argon and further comprising: means for refluxing an intermediate height of the LP column by exchanging latent heat between liquid oxygen withdrawn from the LP column bottom and vapor from the LP column intermediate height; and a compressor for the gasified oxygen.

17. Apparatus according to claim 12 wherein the LP column overhead fluid is predominantly argon and comprises no more than 30% oxygen and further comprising: a means for increasing the pressure of the LP column overhead vapor; a means for increasing the pressure of the LP column bottom liquid oxygen; a means for exchanging latent heat between pressurized overhead vapor and pressurized liquid oxygen; and a means for transporting condensed overhead vapor back to the LP column as reflux.

18. Apparatus according to claim 12 further comprising a second rectification section of the LP column wherein the overhead fluid of the first rectification section is predominantly nitrogen and that of the second section is predominantly argon.

19. In a process for producing oxygen of at least 96% purity in a triple pressure distillation apparatus comprised of a high pressure column, medium pressure column, and low pressure column comprised of an argon stripping section and at least one rectification section, the improvement comprising: providing intermediate reflux to the LP column and intermediate reboil to the MP column by indirect exchange of latent heat from LP column intermediate height vapor to MP column intermediate height liquid; reboiling both the MP and LP columns by latent heat exchange with HP column vapor; transporting substantially all the MP column bottom liquid to the LP column for further purification; withdrawing gaseous overhead nitrogen from the MP column; and withdrawing oxygen of said purity from the bottom of said LP column.

20. The process according to claim 19 further comprising withdrawing liquid oxygen bottom product of at least 98% purity from the LP column; exchanging latent heat between the liquid oxygen and a vapor from the LP column; and refluxing the LP column with at least part of the condensed vapor.

21. The process according to claim 20 wherein the LP column rectification section overhead fluid is predominantly nitrogen and further comprising: directly injecting liquid nitrogen into the LP column overhead; directly injecting part of the oxygen enriched liquid from the HP column bottom into an LP column intermediate height; thermocompressing LP column overhead vapor to the MP column; and thermocompressing LP column intermediate height vapor to the MP column.

* * * * *